US007858861B1

(12) United States Patent
Chen

(10) Patent No.: US 7,858,861 B1
(45) Date of Patent: Dec. 28, 2010

(54) PEDAL SYSTEM AND A DRUM ASSEMBLY USING THE SAME

(76) Inventor: Kuo-Chang Chen, 6980 Whiteoak Drive, Richmond, B.C. (CA) V7E 4Z9

( * ) Notice: Subject to any disclaimer, the term of this patent is extended or adjusted under 35 U.S.C. 154(b) by 0 days.

(21) Appl. No.: 12/613,491

(22) Filed: Nov. 5, 2009

(51) Int. Cl.
*G10D 13/02* (2006.01)

(52) U.S. Cl. ..... 84/422.1

(58) Field of Classification Search ..... 84/421, 84/422.1, 422.3
See application file for complete search history.

(56) References Cited

U.S. PATENT DOCUMENTS 5,627,332 A * 5/1997 Lombardi ..... 84/422.1

* cited by examiner

*Primary Examiner*—Kimberly R Lockett

(57) ABSTRACT

A pedal system of the present invention includes a support element, a connecting shank, a fixation element, a transmission element and an adjusting element. The support element has a pedal and a rotatable axle. The axle inserts through the connecting shank and the fixation element in a rotational operative relationship. The transmission element connects between the pedal and the adjusting element. The fixation element is adapted for a drum hammer to dispose thereon. The connecting shank has a sectorial slot vertically disposed thereon, and a rod transversely inserts through a tip of the sectorial slot. The rod has a radial threaded bore for the adjusting element to engage therewith. The adjustable element is movable along the sectorial slot and being selectively fixed to the connecting shank. As such, the elevation angle of the pedal is adjustable for the player to achieve better performance effect.

8 Claims, 7 Drawing Sheets

PEDAL SYSTEM AND A DRUM ASSEMBLY USING THE SAME

BACKGROUND OF THE INVENTION

1. Field of the Invention

The present invention relates to a pedal system for a percussion instrument, and more particularly for a drum.

2. Description of the Prior Art

Some of the conventional drum assemblies include pedal systems for the player to percuss the drum by foot. However, the elevation angle of the pedal is not easily adjustable, which affects the player's performance.

SUMMARY OF THE INVENTION

The main object of the present invention is to provide a pedal system whose elevation angle of a pedal is adjustable.

To achieve the above and other objects, a pedal system of the present invention includes a support element, a connecting shank, a fixation element, a transmission element and an adjusting element. The support element has a pedal and a rotatable axle. The axle inserts through the connecting shank and the fixation element in a rotational operative relationship. The transmission element connects between the pedal and the adjusting element. The fixation element is adapted for a drum hammer to dispose thereon. The connecting shank has a sectorial slot vertically disposed thereon, and a rod transversely inserts through a tip of the sectorial slot. The rod has a radial threaded bore for the adjusting element to engage therewith. The adjustable element is movable along the sectorial slot and being selectively fixed to the connecting shank. As such, the elevation angle of the pedal is adjustable for the player to achieve better performance effect.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
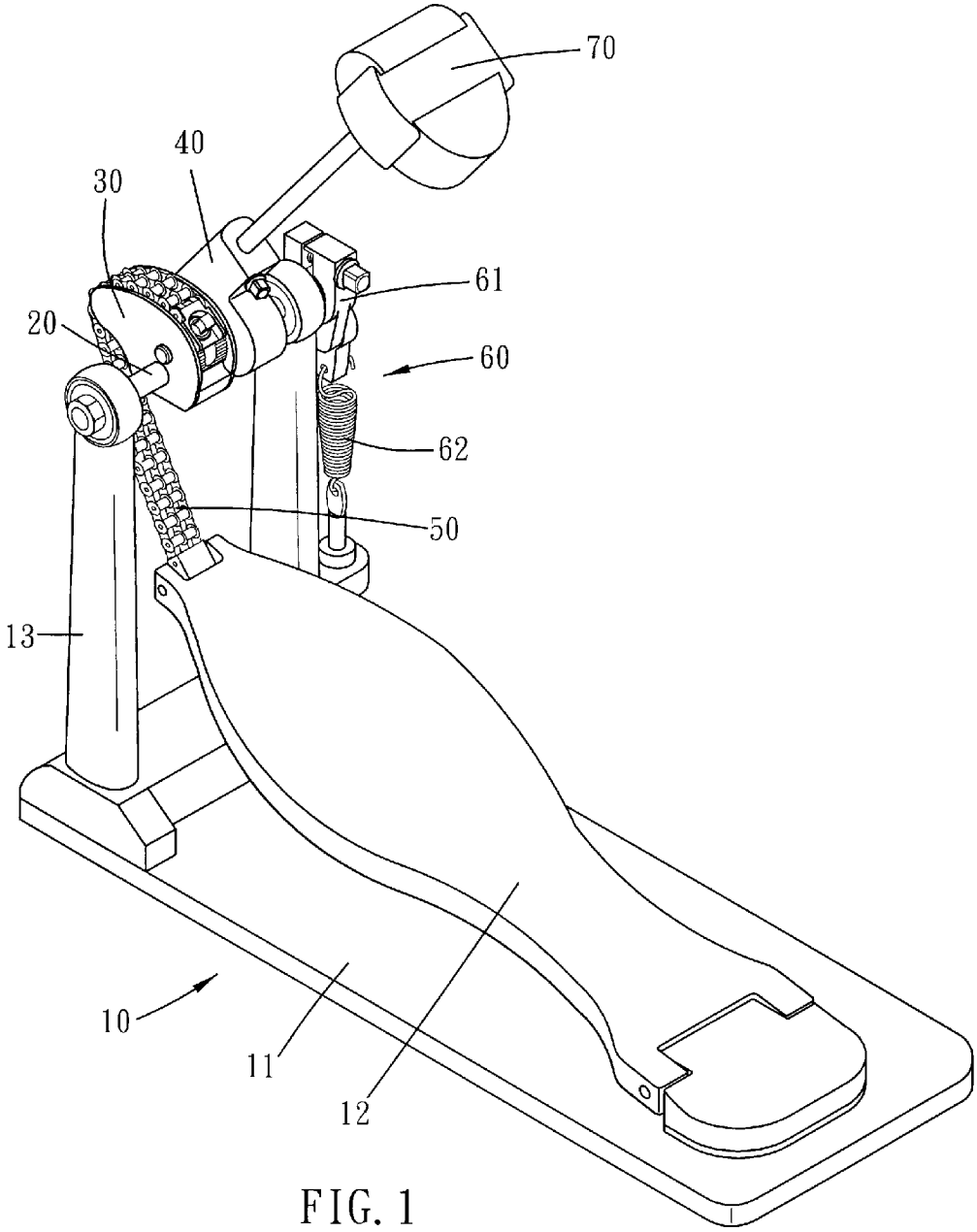
FIG. 1 is a perspective drawing showing a pedal system of the present invention.
Figure 2:
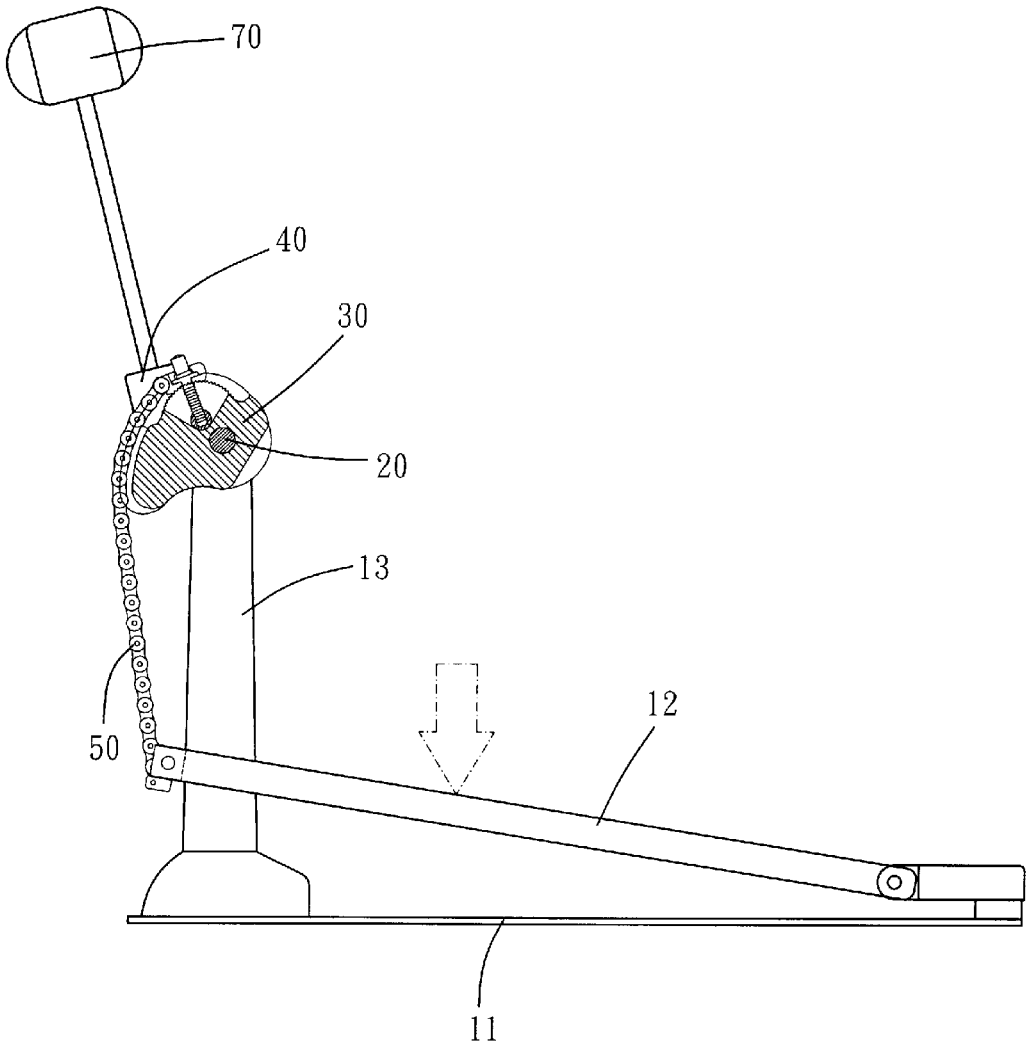
FIG. 2 is a lateral view showing a pedal system, with its pedal at the percussion position, of the present invention.

Please refer to FIG. 1 and FIG. 2. A pedal system of the present invention includes a support element 10. The support element 10 includes a pedal base 11 having a pedal 12 pivotably disposed thereon. As shown in FIG. 1, the pedal 12 locates at a release position when it is not stepped upon. As shown in FIG. 2, the pedal 12 moves to a percussion position when it is stepped upon. Two upright frames 13 are disposed on a side of the pedal base 11, and an axle 20 is rotatably disposed between distal ends of the upright frames 13. Note that the axle 20 can also be supported by a single upright frame. The axle 20 inserts through a connecting shank 30 and a fixation element 40 in a rotational operative relationship, e.g. the axle 20 may have a non-circular profile for the shank 30 and the fixation element 40 to engage therewith.

Figure 3:
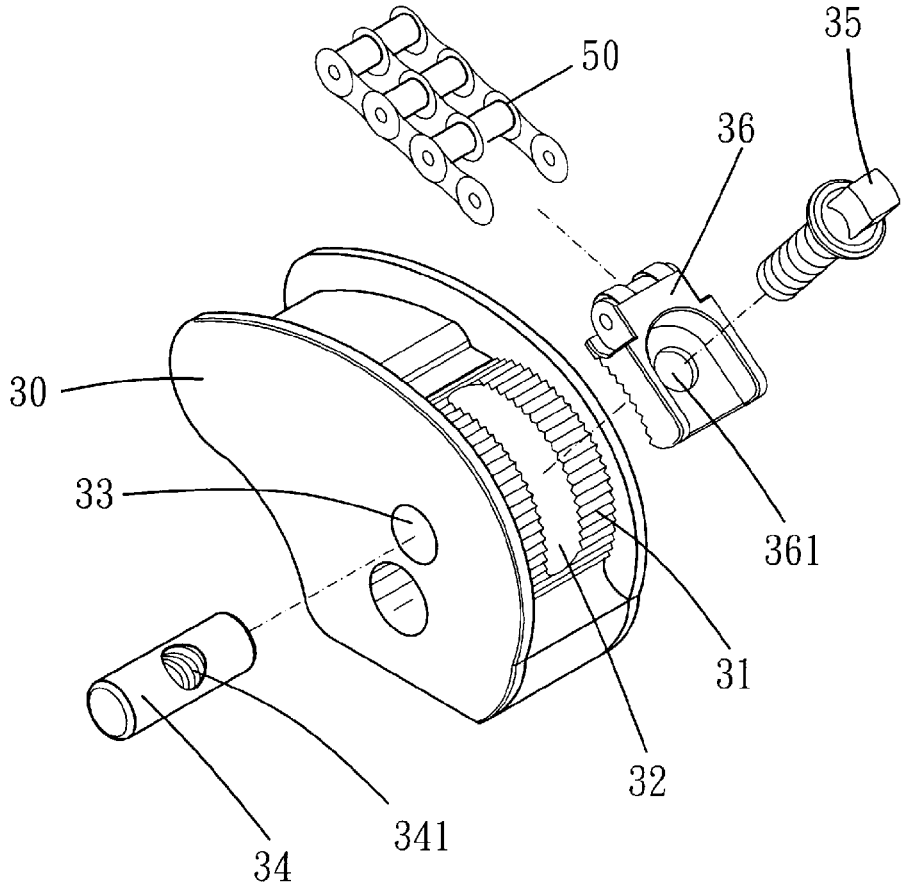
FIG. 3 is a breakdown drawing showing a connecting element of the present invention.
Figure 4:
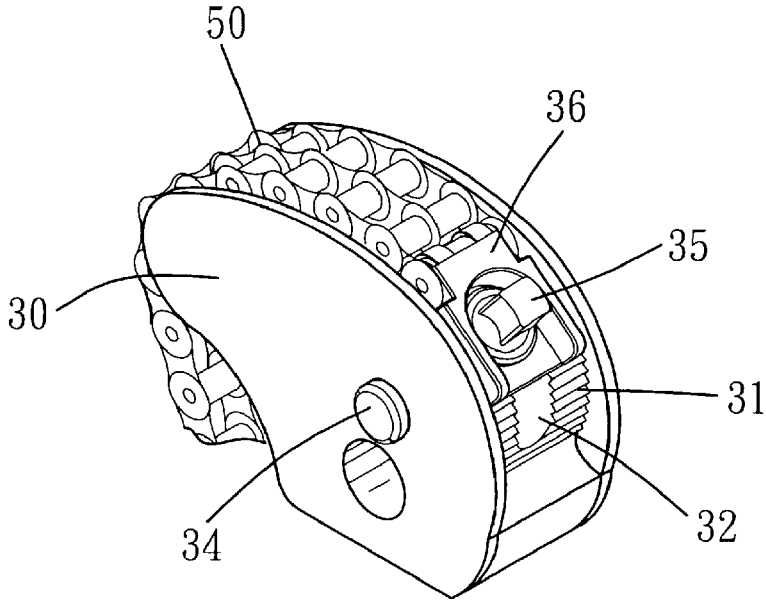
FIG. 4 is a perspective drawing showing a connecting element of the present invention.
Figure 6:
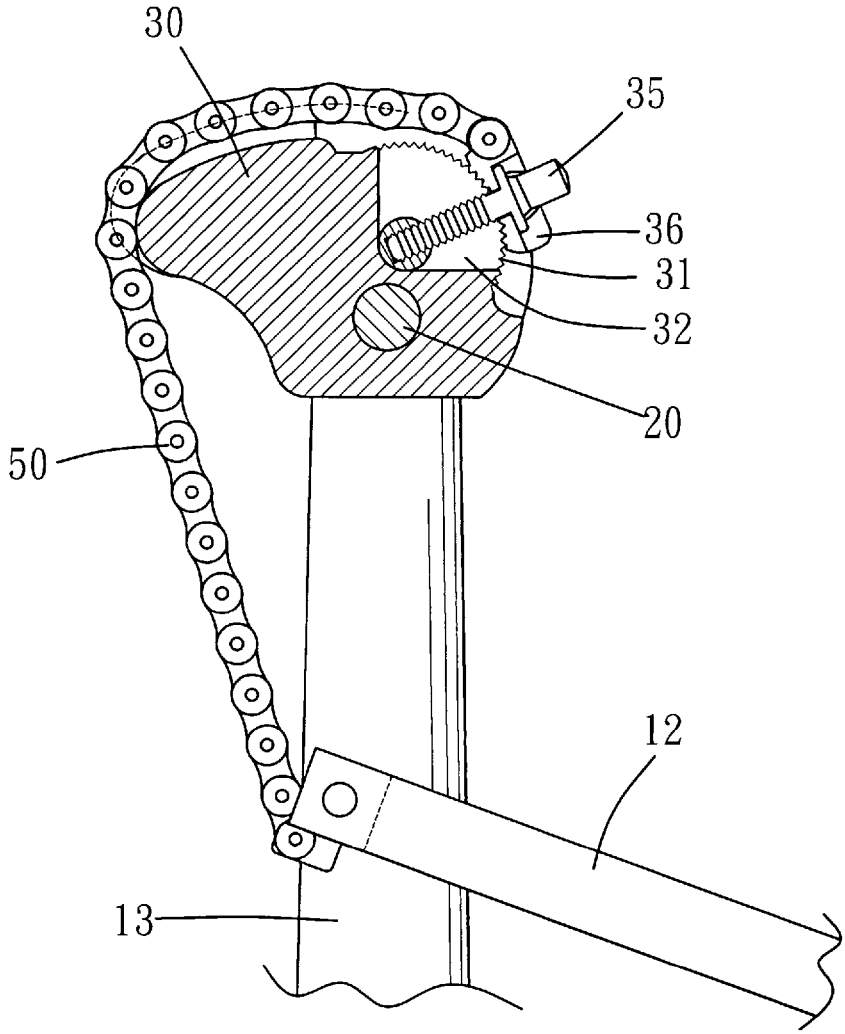
FIG. 6 is a partial profile showing a connecting element of the present invention.

Please refer to FIG. 3, FIG. 4 and FIG. 6. The connecting shank 30 has an arc surface 31 and a sectorial slot 32 vertically disposed on the arc surface 31. The connecting shank 30 further has a connecting bore 33 transversely disposed thereon. The connecting bore 33 communicates with the sectorial slot 32 and locates at a tip of the sectorial slot 32. A rod 34 inserts in the connecting bore 33 and has a radial threaded bore 341. A screw unit 35 inserts through the sectorial slot 32 to engage with the threaded bore 341, and an engaging body 36 is disposed between the screw unit 35 and the arc surface 31. The engaging body 36 has a positioning hole 361 for the screw unit 35 to insert therethrough. The engaging body 36 and the arc surface 31 are formed with lateral teeth to abut against each other. As such, the engaging body 36 is slidable with respect to the arc surface 31 until the screw unit 35 forces the engaging body 36 to tightly abut against the arc surface 31.

Please refer to FIG. 1 again. The engaging body 36 and the screw unit 35 in combination form the adjusting element. The transmission element 50 connects to the pedal 12 at one end thereof, and the transmission element 50 connects to one of the screw unit 35 and the engaging body 36, so that the pedal 12 and the connecting shank 30 are in a motional operative relationship. The transmission element 50 may be a chain 50, as shown in the drawings, or a belt.

A drum hammer 70 is disposed on the fixation element 40. A means is provided for returning the pedal 12 back to the release position. The returning means includes a connecting body 61 and a resilient member 62. The connecting body 61 clamps the axle 20 in a rotational operative relationship. The resilient member 62 connects between the connecting body 61 and the support element 10. Thus the resilient member 62 provides a resilient force to retain the axle 20 to a predetermined position, moving the pedal 12 to the release position. Note that it is possible to install the returning means on the connecting shank 30, the fixation element 40, the transmission element 50 or the pedal 12 instead of the axle 20.

Figure 5:
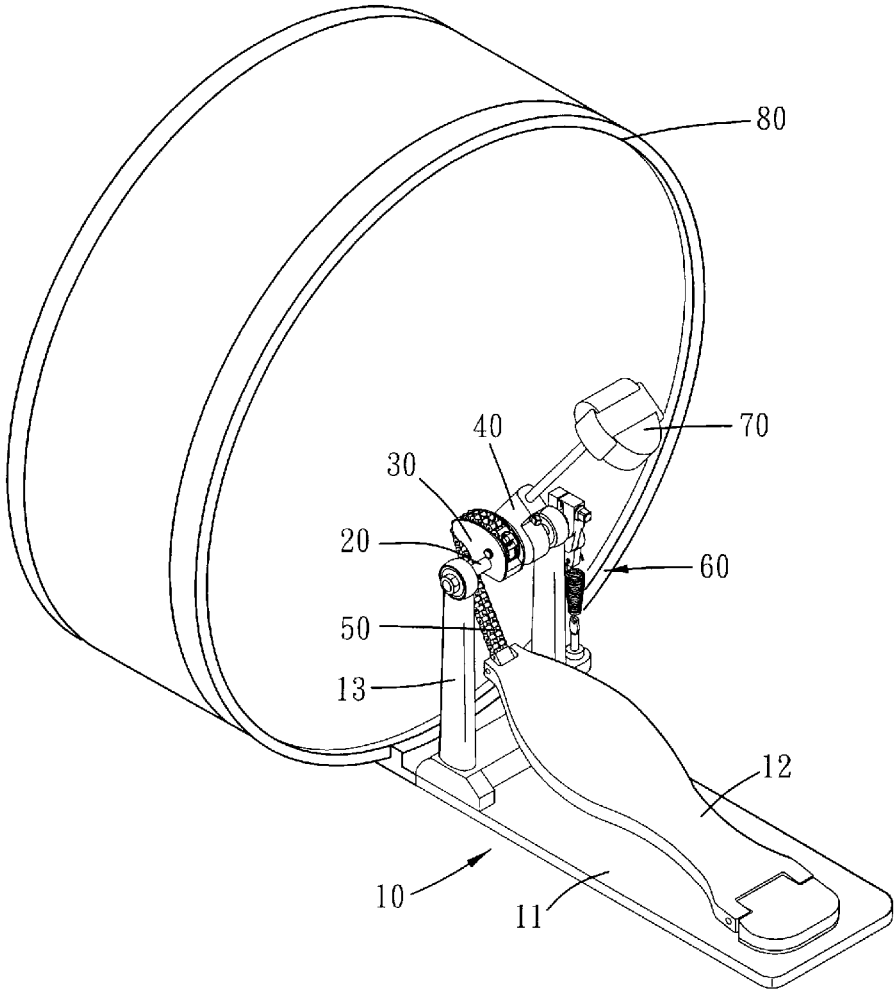
FIG. 5 is a perspective drawing showing a drum assembly of the present invention.
Figure 7:
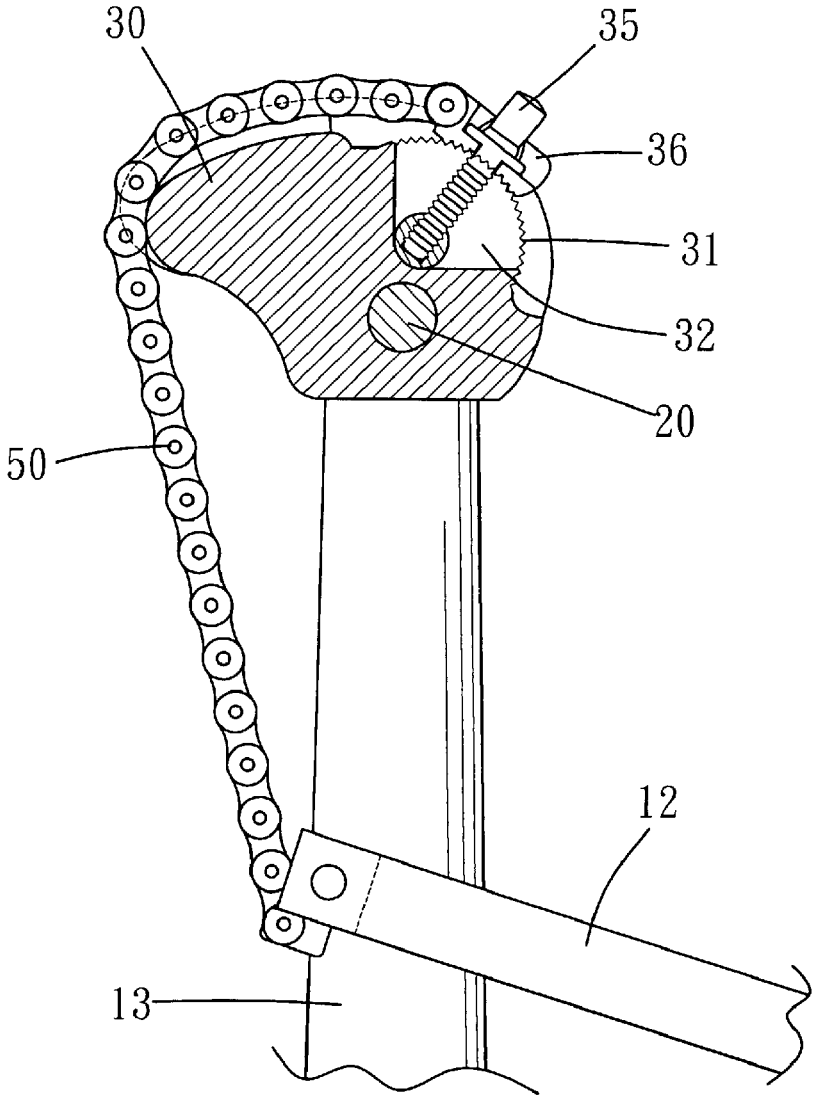
FIG. 7 is a partial profile showing a connecting element of the present invention.

Please refer to FIG. 5. The pedal system of the present invention can be assembled with a drum 80. Specifically, the drum 80 has a drum skin for the drum hammer 70 to strike thereupon to make sounds. Please refer to FIG. 6 and FIG. 7. Since the adjusting element is slidable with respect to the connecting shank 30, the transmission element 50 is adjustable as well to further adjust the elevation angle of the paddle 12. As such, the drum assembly can be accurately tuned to meet the player's tendency, so as to achieve a better performance effect.

What is claimed is:

1. A pedal system for a drum, comprising:

a support element, having a pedal and at least one upright frame, the pedal being swayable between a release position and a percussion position, an axle being rotatably disposed on the upright frame;

a connecting shank, disposed on the axle in a rotational operative relationship, the connecting shank having a sectorial slot vertically disposed thereon and a connecting bore transversely disposed thereon, the connecting bore communicating with the sectorial slot and locating at a tip of the sectorial slot, a rod inserting in the connecting bore, the rod having a radial threaded bore corresponding to the sectorial slot;

a fixation element, disposed on the axle in a rotational operative relationship, the fixation element being adapted for a drum hammer to dispose thereon;

a transmission element, connecting to the pedal at one end thereof;

an adjusting element, a part of the adjusting element inserting in the sectorial slot to engage with the threaded bore, the transmission element connecting to the adjusting element at another end thereof, the adjusting element being movable along the sectorial slot and being selectively fixed to the connecting shank, thereby the connecting shank being rotatable as the pedal pivoting between the release position and the percussion position.

2. The pedal system of claim 1, wherein the connecting shank has an arc surface where the sectorial slot is disposed, the adjusting element includes a screw unit and an engaging body, the screw unit inserts through the sectorial slot to engage with the threaded bore, the engaging body is disposed between the screw unit and the arc surface, the engaging body is slidable with respect to the arc surface until the screw unit forces the engaging body to tightly abut against the arc surface.

3. The pedal system of claim 2, wherein the engaging body and the arc surface are formed with lateral teeth to abut against each other.

4. The pedal system of claim 2, wherein the engaging body has a positioning hole for the screw unit to insert therethrough.

5. The pedal system of claim 2, wherein the transmission element connects to either the engaging body or the screw unit at the another end thereof.

6. The pedal system of claim 1, further comprising a means for returning the pedal back to the release position.

7. The pedal system of claim 1, wherein a drum hammer is disposed on the fixation element.

8. A drum assembly using the pedal system of claim 7, comprising at least one drum skin for the drum hammer to strike thereupon.

* * * * *